US011319953B2

(12) United States Patent
Richter et al.

(10) Patent No.: US 11,319,953 B2
(45) Date of Patent: May 3, 2022

(54) SCREW SPINDLE PUMP HAVING A CONNECTOR HOUSING WITH TWO PARTS ROTATABLE RELATIVE TO ONE ANOTHER AND THE PUMP HOUSING

(71) Applicant: LEISTRITZ PUMPEN GMBH, Nuremberg (DE)

(72) Inventors: Ralf Richter, Fürth (DE); Susanne Brütting, Obertrubach (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 17/063,943

(22) Filed: Oct. 6, 2020

(65) Prior Publication Data

US 2021/0123437 A1 Apr. 29, 2021

(30) Foreign Application Priority Data

Oct. 23, 2019 (DE) ..... 10 2019 128 602.6

(51) Int. Cl.

*F04C 2/16* (2006.01)
*F04C 11/00* (2006.01)
*F04C 15/06* (2006.01)

(52) U.S. Cl.

CPC ..... *F04C 2/16* (2013.01); *F04C 11/001* (2013.01); *F04C 15/06* (2013.01);
(Continued)

(58) Field of Classification Search

CPC ..... F04C 2/16–165; F04C 18/16–165; F04C 15/06; F04C 2230/60–605; F04C 2240/30; F04C 2240/806; F01C 1/16–165
See application file for complete search history.

(56) References Cited

U.S. PATENT DOCUMENTS 2,338,609 A * 1/1944 Whittaker ..... G01F 3/08 73/201
3,269,328 A * 8/1966 Sennet ..... F01C 21/10 418/197

(Continued)

FOREIGN PATENT DOCUMENTS

CN 201306277 Y 9/2009
DE 202010011333 U1 10/2010

(Continued)

OTHER PUBLICATIONS

European Search Report dated Feb. 23, 2021 regarding parallel European Patent Application No. 20192041.0, 2 Pages.

(Continued)

*Primary Examiner* — Laert Dounis
(74) *Attorney, Agent, or Firm* — Lucas & Mercanti, LLP; Klaus P. Stoffel

(57) ABSTRACT

A screw spindle pump, comprising a pump housing having a lead screw received therein and at least one running spindle which meshes with said lead screw, as well as a connector housing which is placed onto the pump housing and has a suction connector and a pressure connector, the two latter fluidically communicating with a suction inlet and a pressure outlet of the pump housing, wherein the connector housing is composed of a first housing part and a second housing part, one of the two latter having the suction connector and the other having the pressure connector, both said housing parts being rotatable relative to the pump housing and both being rotatable relative to one another.

24 Claims, 10 Drawing Sheets

(52) U.S. Cl.
CPC ..... *F04C 2230/60* (2013.01); *F04C 2240/30* (2013.01); *F04C 2240/60* (2013.01); *F04C 2240/806* (2013.01)

(56) References Cited

U.S. PATENT DOCUMENTS

| | | | | | |
|---|---|---|---|---|---|
| 3,576,379 | A * | 4/1971 | Parise | F04C 11/008 417/410.4 |
| 9,127,673 | B2 * | 9/2015 | Krampe | F04C 2/16 |
| 9,765,776 | B2 | 9/2017 | Metz | |
| 10,087,928 | B2 | 10/2018 | Eschner | |
| 2015/0369239 | A1 * | 12/2015 | Nuss | F04C 15/06 418/201.1 |
| 2018/0355864 | A1 * | 12/2018 | Trossmann | F04C 2/16 |
| 2019/0249662 | A1 | 8/2019 | Eschner | |

FOREIGN PATENT DOCUMENTS

| | | | | | |
|---|---|---|---|---|---|
| DE | 202010011626 | U1 | | 10/2010 | |
| DE | 102014000846 | A1 | | 7/2015 | |
| DE | 102013101164 | B4 | | 3/2016 | |
| DE | 102016120579 | B3 | | 4/2018 | |
| EP | 2916007 | B1 | | 2/2017 | |
| JP | 2003176789 | A | * | 6/2003 | F04B 53/00 |
| KR | 100786591 | B1 | * | 12/2007 | F04B 19/12 |
| WO | 2007014540 | A1 | | 2/2007 | |
| WO | WO-2012026085 | A1 | * | 3/2012 | F04C 2/1071 |
| WO | 2013147761 | A2 | | 10/2013 | |
| WO | 2017009877 | A1 | | 1/2017 | |

OTHER PUBLICATIONS

Indian Patent Office issued Office Action dated Jun. 24, 2021 regarding the parallel Indian Patent Application No. 202014041130: 5 pages.

German Office Action, dated Oct. 13, 2020, 5 Pages.

* cited by examiner

SCREW SPINDLE PUMP HAVING A CONNECTOR HOUSING WITH TWO PARTS ROTATABLE RELATIVE TO ONE ANOTHER AND THE PUMP HOUSING

CROSS-REFERENCE TO RELATED APPLICATIONS

The present application claims priority of DE 10 2019 128 602.6, filed Oct. 23, 2019, the priority of this application is hereby claimed and this application is incorporated herein by reference.

BACKGROUND OF THE INVENTION

The invention relates to a screw spindle pump, comprising a pump housing having a lead screw received therein and at least one running spindle which meshes with said lead screw, as well as a connector housing which is placed onto the pump housing and has a suction connector and a pressure connector, the two latter fluidically communicating with a suction inlet and a pressure outlet of the pump housing.

Screw spindle pumps are used in the most varied fields, primarily where liquid media are to be conveyed, for example in the oil and gas industry, the chemical or petrochemical industry or in the power generation sector, to mention only a few fields of application. A screw spindle pump has a pump housing in which at least two spindles are received and rotatably mounted, specifically a lead screw which is coupled to a drive motor that is screwed to the pump housing, said lead screw being driven by said drive motor, and at least one running spindle which meshes with the lead screw, wherein two running spindles which mesh with the lead screw that is usually disposed so as to be centric between said running spindles may also be provided. The pump housing is embodied in the manner of a cartridge, so to speak, and has a suction inlet by way of which the medium to be conveyed is suctioned into the pump housing, and a pressure outlet by way of which the fluid conveyed by way of the spindles is discharged at a higher pressure.

A connector housing is placed onto the pump housing, that is to say that the cartridge-type pump housing is inserted into the connector housing. The connector housing has corresponding interfaces in the form of a suction connector and a pressure connector, to which corresponding infeed and outfeed lines by way of which the medium to be conveyed is supplied and discharged, respectively, can be connected. The suction connector fluidically communicates with the suction inlet of the pump housing, while the pressure connector fluidically communicates with the pressure outlet of the pump housing. The fundamental construction and the function of such a screw spindle pump is known.

In known screw spindle pumps there is the possibility of disposing the suction connector and the pressure connector at various positions on the connector housing so as to adapt to the connecting situation of the infeed and outfeed lines which may be routed to the screw spindle pump in various ways. The suction connector and the pressure connector can thus be disposed in one line in terms of the longitudinal axis of the screw spindle pump, so to speak; said suction connector and said pressure connector can be mutually offset by 90°; said suction connector and said pressure connector can however also be mutually offset by 180°; and the suction connector can finally also be disposed axially or on the end side, respectively, while the pressure connector is disposed radially. The multiplicity of potential arrangements and the fact that each connector housing has to be individually made depending on the connection geometry required, leads to the production of such a screw spindle pump being very complex since each connector housing is a bespoke product which is adapted to the application situation, so to speak.

SUMMARY OF THE INVENTION

The invention is thus based on the object of specifying a screw spindle pump which is improved in comparison to the above.

In order for said object to be achieved, it is provided according to the invention in a screw spindle pump of the type mentioned at the outset that the connector housing is composed of a first housing part and a second housing part, one of the two latter having the suction connector and the other having the pressure connector, both said housing parts being rotatable relative to the pump housing and both being rotatable relative to one another.

In the screw spindle pump according to the invention it is not a connector housing in one part which is used but particularly advantageously a connector housing in two parts, composed of a first housing part and a second housing part which in terms of the pump longitudinal axis are disposed so as to be axially behind one another. The pump housing on the external side, in the region in which the two housing parts are placed on one another, is embodied so as to be cylindrical; the two housing parts are correspondingly embodied so as to be hollow-cylindrical, wherein the one housing part is embodied as a hollow cylinder which is axially open on both sides, said one housing part being completely pushed onto the pump housing, while the second housing part is embodied in the manner of a pot, so to speak, and has a base but is likewise pushed onto the pump housing. The one housing part has the suction connector, while the other housing part has the pressure connector.

According to the invention, double rotatability of the three housing elements relative to one another is provided. On the one hand, the two housing parts are mounted so as to be rotatable on the pump housing, that is to say that both housing parts can be rotated relative to the pump housing, this fundamentally enabling the two housing parts to be rotated about the pump longitudinal axis such that there is the possibility of being able to vary the radially disposed suction connectors and pressure connectors in terms of their circumferential position or rotated position relative to the pump housing. Moreover, there is a rotatability of the two housing parts relative to one another, that is to say that no fixed, invariable, mutual positioning of the two housing parts exists but likewise variable positioning by rotation about the pump longitudinal axis. This enables the radial suction connectors and pressure connectors to be brought to dissimilar positions relative to one another. It is thus preferably possible for the suction connector and the pressure connector to be disposed so as to be aligned along the pump longitudinal axis, thus behind one another in a linear manner, wherein both connectors by conjoint rotation about the pump longitudinal axis in terms of the positionally fixed pump housing can be disposed in a centric 0° position, in a position rotated by +90° in one direction and in a position rotated by −90° in the other direction, just as said suction connector and said pressure connector may theoretically also be conjointly rotated by 180°. There is moreover the possibility for the suction connector and the pressure connector not to be mutually aligned but to assume an angle of, for example, 90° or 180° relative to one another, to which end it is only necessary for the two housing parts to be rotated about the housing longitudinal axis by the corresponding desired intermediate angle between the two connectors. Irrespective of the relative position which the two housing parts assume in relation to the pump housing or to one another, in each position the suction connector of the one housing part is fluidically coupled to the suction inlet of the pump housing, while the pressure connector of the other housing part is fluidically coupled to the pressure outlet of the pump housing part.

The screw spindle pump according to the invention thus particularly advantageously enables a great multiplicity of different screw spindle pumps which differ in terms of the connection geometry, or the position of the suction connector and the pressure connector, respectively, to be produced while using a standardized pump housing as well as the two likewise standardized housing parts. It is only necessary for the two housing parts to be pushed onto the pump housing and to move said two housing parts to the desired rotated position relative to the pump housing and relative to one another, depending on the required connection geometry, whereupon it is now only necessary for the two housing parts to be mutually fixed as well as one housing part to be connected to the pump housing such that the components are fixedly connected to one another in the desired alignment or geometry, respectively. It is thus possible for a multiplicity of standardized first and second housing parts to be stocked, since a multiplicity of different screw spindle pump types can be produced therefrom while using the standardized pump housing. There is particularly advantageously no longer a complex bespoke production of an integral connector housing which is produced only for a specific screw spindle pump, or a specific screw spindle pump type, respectively, as is provided in the prior art. Rather, the screw spindle pump according to the invention is a highly flexible modular system which enables the production of different types of pumps in an extremely simple manner.

Each housing part herein is rotatable relative to the pump housing by at least 45°, preferably by at least 90°, and particularly by at least 180°, but even larger rotation angles of up to 360° are conceivable, that is to say that there is ultimately no limitation in terms of the rotation of a housing part relative to the pump housing.

A suction chamber and a pressure chamber are to be configured within the connector housing toward the pump housing, wherein the suction connector and the suction inlet lie in the suction chamber, or lead into the latter, while the pressure connector and the pressure outlet lie in the pressure chamber, or lead into the latter, respectively. In order for these chambers to be configured, or to be defined so as to be sufficiently sealed, respectively, it is provided in a refinement of the invention that sealing elements by way of which the housing parts are mutually sealed and at least one housing part is also sealed in relation to the pump housing are disposed. The two housing parts are mutually sealed by way of at least one first sealing element, because said two housing parts have to be able to be rotated relative to one another, as described, so that there has to be a sealing plane therebetween. Moreover, at least one housing part is also sealed in relation to the pump housing. The separation between the suction chamber and the pressure chamber at the interface between the connector housing and the pump housing is effected by way of this seal, on the one hand, just as the connector housing overall is also sealed relative to the pump housing. This means that there are two sealing planes between the at least one housing part and the pump housing, specifically the sealing plane between the suction chamber and the pressure chamber, on the one hand, and the sealing plane between the connector housing per se and the pump housing, on the other hand. Said sealing takes place by way of two separate sealing elements. Since one housing part is configured in the shape of a pot and has an axial end wall, or a base, respectively, by way of which the connector housing is closed on that side, no additional sealing plane thus has to be provided there.

In a specific implementation of this design embodiment according to the invention the housing part that has the suction connector is sealed in relation to the housing part that has the pressure connector by way of a first sealing plane, while the housing part that has the pressure connector is sealed in relation to the pump housing, wherein two sealing planes are configured here, specifically the one sealing plane which separates the suction chamber and the pressure chamber from one another, and the other sealing plane which seals the connector housing and the pump housing from one another.

In order for the two housing parts to be mutually sealed in a simple manner by means of a sealing element, one advantageous refinement of the invention provides that one of the housing parts has a cylindrical flange which extends axially and engages in an annular beading on the other housing part, wherein the sealing element that mutually seals the two housing parts seals between the flange and the annular beading. The flange and the annular beading thus engage in one another in an axial manner such that radial sealing between said flange and said annular beading is possible by way of the sealing element. Axial sealing would also be possible here. Annular seals that are inserted in annular receptacles which are configured on the corresponding components are preferably used as sealing elements. These annular seals or O-rings which are preferably from a suitable plastics material are fixedly anchored in the corresponding annular receptacles and by way of sufficient tension bear on the corresponding counterpart such that a defined sealing plane is configured. The annular seals even in the assembled state permit the housing parts to rotate relative to one another as well as the one housing part to rotate relative to the pump housing, wherein this rotation takes place only once and only by a correspondingly small angular increment until the desired rotated position is assumed, whereupon the components are fixedly connected to one another, as described, such that further rotation no longer takes place.

As described, the suction inlet is in any case fluidically connected to the suction connector and the pressure outlet is an any case fluidically connected to the pressure connector, irrespective of the rotated position that the housing parts assume relative to the pump housing. In order for this to be implemented in a simple manner, in a refinement of the invention the suction inlet is formed by one radial inlet opening, or a plurality of radial inlet openings configured so as to be distributed in the circumferential direction on the pump housing, which open(s) out into a chamber that is configured between the one housing part and the pump housing, and the pressure outlet is formed by one radial outlet opening, or a plurality of radial outlet openings configured so as to be distributed in the circumferential direction on the pump housing, which open(s) out into a chamber that is configured between the second housing part and the pump housing. Consequently at least one radial inlet opening and outlet opening, preferably however a plurality of radial inlet openings and outlet openings, which in each case open(s) out into the respective, in most instances annular, chambers is/are provided on the pump housing, such that there is a fluidic coupling in any case, irrespective of the rotated position. The inlet openings and outlet openings can be embodied as radial bores; alternatively, said inlet openings and outlet openings can also be embodied as comparatively large rectangular openings in the manner of windows. Such a design embodiment of the inlet openings in the manner of windows is conceivable, for example, for forming the suction inlet, wherein such an opening in the manner of a window can extend by approx. 90° in the circumferential direction. In this instance, two such inlet openings in the manner of windows can be provided so as to be offset by 180°, for example. The outlet openings can be embodied in the form of radial bores, for example, wherein four or six such radial bores can be provided so as to be distributed about the pump housing circumference, because said radial bores are smaller than the openings in the manner of windows. This means that the inlet openings and outlet openings can fundamentally be of the same type or else of dissimilar types.

Since the pump housing is axially closed by way of an axial base on which the two spindles or the three spindles are typically hydraulically mounted and supported, it can be provided for ensuring a sufficient inflow cross section that said end-proximal base of the pump housing is provided with further axial inlet openings which conjointly with the radial inlet openings likewise form the suction inlet. This means that not only a radial inflow into the pump housing is possible but also an axial inflow.

The pressure connector as described is disposed radially, thus proceeds laterally from the connector housing. The suction connector can also be radial, can thus likewise run so as to be radial to the connector housing or the pump longitudinal axis, respectively. However, there is the possibility for an axial suction connector to also be additionally provided here, said axial suction connector being disposed in the extension of the pump longitudinal axis, so to speak, and being configured on the base of the end-proximal pot-type housing part. This axial suction connector expands the range of connectors and thus the entire range of pump types which can be produced by way of the modular system according to the invention. Depending on whether the radial suction connector or the axial suction connector is presently being used, the non-utilized suction connector is of course tightly closed by way of a suitable closure element, in particular a closure plug, said closure plug, while using a sealing element, being screwed into a corresponding internal thread configured in the bore which defines the suction connector. Alternatively, a closure plate, thus a dummy plate, can be fastened, in particular screw-fitted, in order for the suction connector which is surplus to requirement to be closed. If there is such an axial suction connector, the axial inlet openings described above are preferably configured in the base of the pump housing, said axial inlet openings in this instance lying in an axial extension of the axial suction connector, so to speak.

As described, the screw spindle pump according to the invention is distinguished in that the two housing parts can be rotated relative to the pump housing as well as relative to one another. Said two housing parts are then fixed to one another in the desired rotated position. It is conceivable herein that the housing parts in distinguished rotated positions or in arbitrary rotated positions relative to one another can be fixed on one another, and one housing part in terms of the rotated position thereof in distinguished arbitrary positions relative to the pump housing can be fixed on the latter. This means that either predefined rotated positions relative to one another which are defined by way of a defined angular pitch in the circumferential direction, or arbitrary rotated positions which are ultimately not defined, can be assumed. A plurality of defined rotated positions are typically sufficient in order for the desired application-related geometric range to be covered; nevertheless, application scenarios in which an angle of rotation which by virtue of local circumstances deviates from a usual line geometry are also conceivable.

The mutual fixing of the two housing parts as well as the fixing of the one housing part on the pump housing preferably takes place by way of screw connections, wherein the screw connections are axial.

According to a first alternative of the invention, in which the components can be fixed on one another at the predetermined rotated position, it can be provided herein that a plurality of axial through bores are provided so as to be distributed in the circumferential direction on the end-proximal housing part, and a plurality of axial internal-thread bores are provided so as to be distributed at the same pitch in the circumferential direction on the neighboring housing part, and that a plurality of axial through bores are provided so as to be distributed in the circumferential direction on a radial flange of the pump housing, and a plurality of axial internal-thread bores are provided so as to be distributed at the same pitch in the circumferential direction on the neighboring housing part. The defined rotated positions here are thus defined by way of corresponding through bores and internal-thread bores with the same pitch, that is to say that the pitch angle is defining in terms of the rotated positions to be assumed. The mutual fastening of the parts is possible only when the corresponding through bores and internal-thread bores are in mutual alignment.

The pitch angle, or the pitch, respectively, of the through bores and the internal-thread bores herein can be between 15° and 90°, in particular between 22.5° and 45°. Depending on how the pitch angle is conceived, a smaller or greater number of potential angles of rotation is consequently provided, wherein the respective pitch angles is always to be chosen such that the suction connector and the pressure connector are in any case mutually aligned in an axial manner or can be mutually positioned so as to be disposed at +/−90° in order to be able to form the most commonplace geometries. This is possible, for example, by way of a pitch angle of 15°, 22.5°, and 45°, wherein these pitch angles also enable 45° positions. The smaller the pitch angle, the more intermediate positions can be assumed.

In order for the alternative with an arbitrary choice of rotated angles to be implemented, according to the invention at least two axially open slots can be provided so as to extend in the circumferential direction on the end-proximal housing part, and a plurality of axial internal-thread bores can be provided so as to be distributed in the circumferential direction on the neighboring housing part, and/or at least two axially open slots are provided so as to extend in the circumferential direction on a radial flange of the pump housing, and a plurality of axial internal-thread bores can be provided so as to be distributed in the circumferential direction on the neighboring housing part. Axially open oblong plug holes which in portions encircle the circumference and through which the connection screws are guided are thus used here on one housing part and on the pump-housing-proximal radial flange, said connection screws by way of the screw heads thereof bearing on the peripheries of the slots and being screwed into the corresponding internal threaded bores which have a suitable pitch and are disposed on the central housing part between the end-proximal housing part and the radial flange. By virtue of the slot assembly, arbitrary rotated positions of the two housing parts relative to one another as well as of the entire connector housing relative to the pump housing can be assumed. For example, two such slots which in each case extend about the circumference by approx. 170°, for example, can be provided, and six internal-thread bores can be provided, for example, such that three connection screws engage in each case through one slot, wherein the internal-thread bore pitch in this instance would be 60°, for example.

It is furthermore conceivable for the connection of the two housing parts in an arbitrary rotated angular position and for the connection of the one housing part to the pump housing to be enabled only in distinguished positions, or vice versa. Various connection possibilities on one pump are thus also possible.

In order to implement a discharge possibility for fluid situated in the pump when required, this being necessary in the case of maintenance work, for example, a plurality of discharge bores which are provided with releasable closure plugs and lead into the interior of the connector housing are expediently provided so as to be distributed in the circumferential direction on each housing part. These discharge bores communicate with the respective annular chamber of the suction chamber and of the pressure chamber. A plurality of discharge bores which are distributed in the circumferential direction are provided per housing part, so as to thereby ensure that one discharge bore is always oriented at least approximately downward, depending on the rotated position of the respective housing part. Three discharge bores which are disposed so as to be mutually offset by 90° are preferably used per housing part, wherein two discharge bores are disposed so as to be offset by 90° in relation to the suction connector or the pressure connector, while the third discharge bore is diametrically opposite the latter.

In order to implement a defined housing interface on the connector housing, a flat fastening region having a plurality of internal-thread bores for fastening a line to be connected to the suction connector and to the pressure connector is expediently configured in the region of the suction connector and the pressure connector on both housing parts. The respective line can be connected directly to said fastening region; the flat fastening region forms a corresponding connector plane which can be sealed in a simple manner in relation to the line. The fastening of the line takes place by way of corresponding connection screws which are screwed into the fastening-region-proximal internal-thread bores.

This flat fastening region can however also serve as an interface for an adapter plate which the system according to the invention can furthermore comprise. This adapter pate is able to be releasably fastened to the fastening region, to which end the adapter plate has corresponding through bores through which connection screws which are screwed into the fastening-region-proximal internal-thread bores are guided. The adapter plate per se has corresponding fastening installations, in particular internal-thread bores, for fastening at least one connector flange plate which in turn forms the corresponding connector interface for the line. By interposing this adapter plate, there is the possibility of making available a connector interface for a plurality of dissimilar connector flange plates which have dissimilar DIN connector interfaces for the line, so as to be able to connect dissimilar types of lines in this way. The adapter plate of course has a corresponding, sealed, passage toward the respective suction connector and pressure connector. The term "adapter plate" is to be understood to be any adapter element which can be fixed to the suction connector and the pressure connector, or the corresponding fastening region, respectively, on the one hand, and which has the corresponding fastening possibilities for a connector flange plate.

While there is the possibility of hooking the screw spindle pump into the branch of the line, consequently of fastening said screw spindle pump to the infeed line and the outfeed line and to support the screw spindle pump by way of these lines, it is likewise conceivable for this to be performed by means of a stand element. Such a stand element is able to be releasably attached, thus can be disposed when required. The stand element herein is preferably fixed on the pump housing, for example on the radial flange of the latter.

The stand element can be embodied so as to be L-shaped or U-shaped and have a leg having at least two bores provided thereon, screw connections by way of which the pump housing is connected to the neighboring housing part engaging through said bores. This means that the stand element is fixed by way of the connection screws by way of which the pump housing and the neighboring housing part are also connected. In the case of an L-shaped stand element, the second leg which runs parallel to the pump longitudinal axis in this instance bears on the floor; the pump per se is only supported by way of the in this instance vertical leg which is fixed to the pump housing. In the case of a U-shaped stand element, a third leg which projects in a vertically upward manner, for example, and which bears on the connector housing and defines a second support plane is provided on the lower, bearing, leg. It is hereby possible for even comparatively large and heavy pumps to be securely supported.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
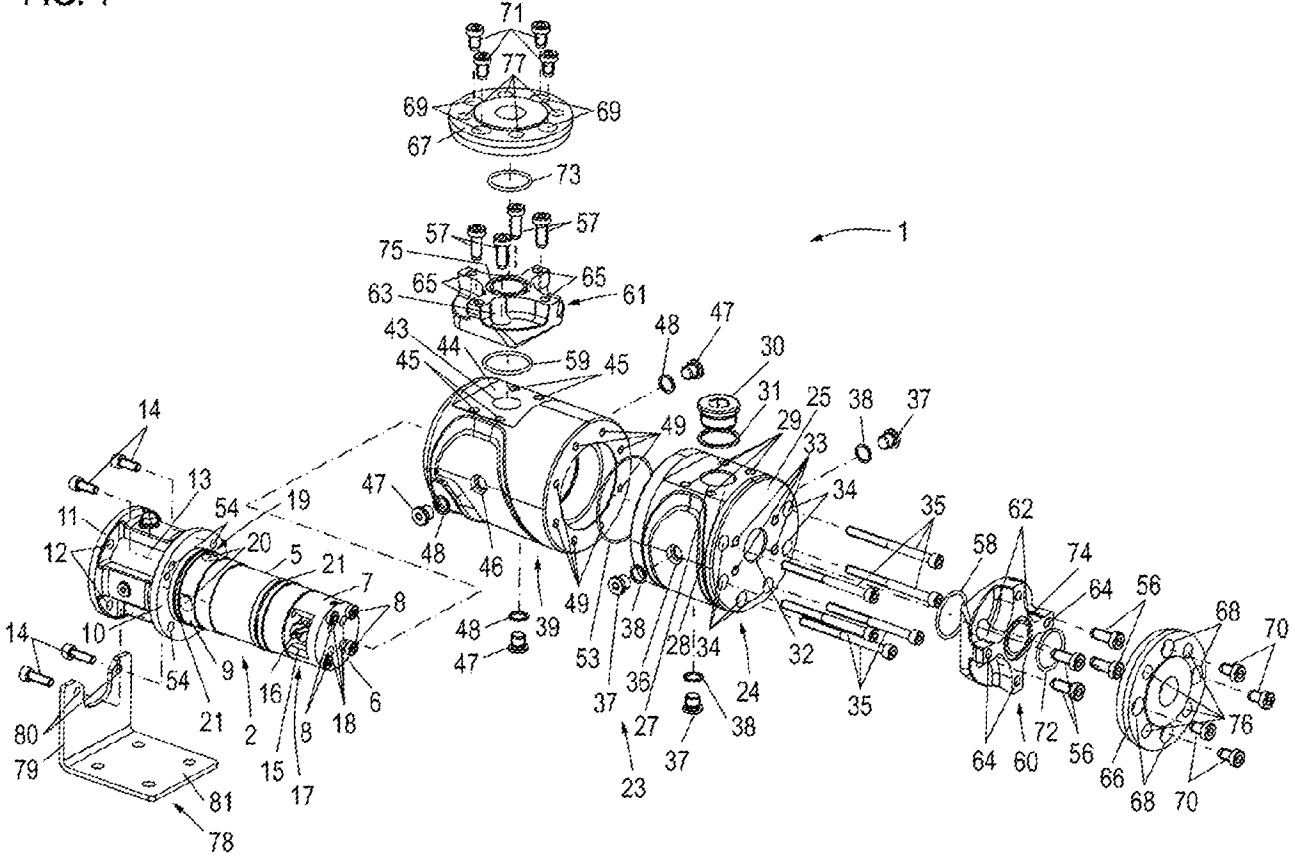
FIG. 1 shows an exploded view of a screw spindle pump according to the invention.

FIG. 1 shows an exploded illustration of a screw spindle pump 1 according to the invention. Said screw spindle pump 1 comprises a pump housing 2 in which a lead screw 3 (cf. FIG. 2), which by way of a connection pin 4 is to be connected to a drive motor (not shown in more detail) that is to be connected to the pump housing 2, as well as at least one running spindle 16 which meshes with the lead screw 3 are received. The pump housing 2 has a cylindrical housing portion 5 which is axially delimited by way of a base plate 6 of an end-proximal base part 7. This base part 7 by way of corresponding screw connections 8 is connected to a second pump housing part 9 which, besides the further part of the cylindrical portion 5, has a radial flange 10 and which is furthermore axially delimited by way of an end-proximal flange 11 to which the housing of the drive motor is to be fastened. To this end, corresponding fastening bores 12 for placing corresponding connection screws are provided.

Trough-shaped depressions 13 which serve for placing connection screws 14, with the aid of which a connector housing (yet to be described hereunder) is fixed to the pump housing 2 are configured in the region between the radial flange 10 and the connector flange 11.

First inlet openings 15 are provided on the cylindrical portion 5 of the pump housing 2 in the region of the base plate 6, wherein two such inlet openings 15 are provided so as to be mutually opposite. The inlet openings 15 are of a quasi-rectangular cross section and configured in the manner of windows and extend over an angular segment of approx. 90°, for example. The running spindle 16 can be seen through the inlet opening 15 shown in FIG. 1. These inlet openings 15 define a suction inlet 17 which is furthermore formed by axial inlet openings 18 which are configured on the base plate 6. Fluid to be conveyed makes its way into the operating region of the spindles 3, 16 by way of this suction inlet 17.

Furthermore configured on the pump housing 2 are a plurality of outlet openings 20 in the form of radial bores forming a pressure outlet 19, wherein four inlet openings 20 which are mutually offset by 90° are provided in the example shown. The conveyed fluid exits said inlet openings 20 again at a corresponding pressure.

Figure 2:
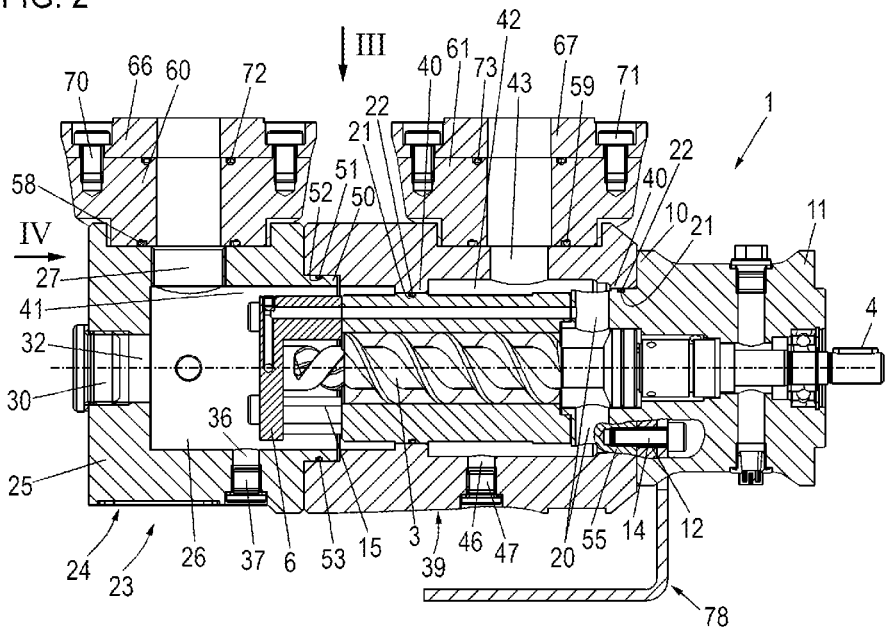
FIG. 2 shows a sectional view through a screw spindle pump according to the invention.

Furthermore provided are two annular receptacles 21 which are provided on the cylindrical portion 5 and in which in each case one annular seal 22 which serves for sealing in relation to the connector housing is inserted, cf. FIG. 2. Simple O-rings are thus used as annular seals.

In the case of the assembled pump, a connector housing 23 is pushed onto the pump housing 2, or the pump housing 2 by way of the cylindrical portion 5 thereof is pushed into the connector housing 23, respectively. The connector housing 23 is composed of a first housing part 24 which is embodied in the manner of a pot and has a base 25 as well as a cylindrical cavity 26 in which the front end of the pump housing 2 engages, cf. FIG. 2. The first housing part 24 has a first suction connector 27 in the form of a radial internal-thread bore which is configured on a flat fastening portion 28 which offers a flat fastening interface for an infeed line to be connected or for an adapter plate yet to be described hereunder. Four internal-thread bores 29 to which either the line or the adapter plate can be screwed are configured on the fastening portion 28.

Furthermore shown is a closure plug 30 having an assigned annular seal 31, said closure plug 30 to be optionally placed. The closure plug 30 is screwed into the suction connector 27 if the latter is not to be required.

This is the case when the second suction connector 32, which is configured on the base plate 25 and is likewise configured in the form of an internal-thread bore and is likewise assigned four fastening bores 33 for connecting the infeed line, or an adapter plate, is used. Since such an optional axial connection of an adapter plate is presently illustrated, cf. FIG. 1, the closure plug 30 would consequently have to be screwed into the first pressure connector 27. Should the adapter plate be placed on the first pressure connector 27, the closure plug 30 would of course have to be screwed into the second pressure connector 32.

The first housing part 24 on the base plate 25 furthermore has a plurality of through bores 34 through which corresponding connection screws 35 which effect corresponding screw connections and which serve for fixedly connecting the first housing part 24 to a second, axially adjoining, housing part which is to be described hereunder, are driven in.

Furthermore provided on the first housing part 24 are a total of three discharge bores 36 which are preferably disposed so as to be offset by 90°, one of said discharge bores 36 being shown in FIG. 1 and one in FIG. 2, and which are in each case closed by means of a closure plug 37 having an assigned annular seal 38. Fluid situated in the pump can be discharged by way of these discharge screws in the case of maintenance.

Furthermore shown is a second housing part 39 which is axially contiguous to the first housing part 24 and, when pushed onto the cylindrical shoulder 5 of the pump housing 2, is disposed between the first connector housing 24 and the radial flange 10. Said second housing part 39 is embodied as a hollow cylinder, thus having a hollow-cylindrical internal shape, cf. FIG. 2, wherein two annular shoulders 40 which project radially inward are configured on the internal circumference, cf. FIG. 2, the respective annular seal 22 bearing in a sealing manner on said annular shoulders 40. In this way, two mutually separate chambers are configured when viewed in the axial direction of the pump, specifically a suction chamber 41 in the region of the first housing part 24 and of the second housing part 39 up to the first annular shoulder 40 and the sealing plane situated there, wherein the two suction connectors 27, 32 open into the suction chamber 41, as well as a pressure chamber 42 between the second housing part 39 and the pump housing 2 in the region between the two sealing planes formed by way of the annular seals 22, wherein the pressure connector 43 which is configured on the second housing part 39 opens out into this suction chamber, cf. FIG. 2. The outlet openings 20 also open out into this pressure chamber 42, just like the two inlet opening 15 open into the suction chamber 41, such that there is a fluidic connection from the respective suction connector 27, 32 to the pressure connector 43.

The pressure connector 43 here too is configured on a flat fastening portion 44 and is again embodied in the form of an internal-thread bore. The flat fastening portion 44 again serves as a fastening interface for a discharging line or for an adapter plate yet to be described hereunder. Corresponding internal-thread bores 45 are also provided here for fastening the line, or the adapter plate, respectively.

The second housing part 39 also has three discharge bores 46 which are disposed so as to be distributed by 90°, for example, and which are closed by way of corresponding closure plugs 47 having an assigned annular seal 48. Fluid situated in the pressure chamber 42 can be discharged by way of said discharge bores 46, while fluid situated in the suction chamber can be discharged by way of the discharge bores 36.

In order for the two housing parts 24, 39 in the push-fitted state to be fastened to one another by way of the connection screws 35, axially running internal-thread bores 49, just like the through bores 34, are provided on the end side of the second housing part 39. The connection screws 35 are screwed into said internal-thread bores 49 such that the two housing parts 24, 39 are fixedly screwed to one another in an axial manner. In order for said two housing parts 24, 39 to also be mutually sealed, the first housing part 24 has an axially extending annular flange 50, cf. FIG. 2, which engages in an annular beading 51 on the second housing part 39. An annular seal 53 in the form of an O-ring is received in an annular receptacle 52 on the annular flange 50 such that the two housing parts 24, 39 are mutually sealed in a radial manner.

As is shown in FIG. 1, the through bores 34 and the internal-thread bores 49 are offset so as to be equidistant about the circumference. Said through bores 34 in the example shown have a pitch, or a pitch angle, respectively, of 45°. This means that the two housing parts 24, 39 can be disposed and mutually fixed at different rotated positions relative to one another.

In the context of assembling, the second housing part 39 is first pushed onto the cylindrical portion 5 on which the corresponding annular seals 22 are already disposed, until said second housing part 39 bears on the radial flange 10. Thereafter the second housing part 24 on which the annular seal 53 is disposed is pushed on. The two housing parts 24, 39 are brought to the desired rotated position relative to one another just like said two housing parts 24, 39 are also conjointly brought to a desired rotated position relative to the pump housing 2, or to the radial flange 10, respectively. Once the corresponding rotated positions are assumed, the two housing parts 24, 39 by way of the connection screws 35 are fixedly screwed to one another, on the one hand, and the entire connector housing 23 is fixed by way of the connection screws 14 which are driven through corresponding through bores 54 on the radial flange 10 and screwed into corresponding axial internal-thread bores 55 on the end side of the second housing part 39, on the other hand. All three housing parts are thus brought to a desired rotated position relative to one another, on the one hand, but are also fixedly screwed to one another in an axial manner, on the other hand.

As described, there is either the possibility for the respective line at the required suction connector 27 or 32 as well as at the pressure connector 43 to be screwed directly to the fastening portion 28, or the base 25, or the fastening portion 44, respectively, corresponding connection screws 56, 57 serving to this end. The corresponding line is sealed in relation to the corresponding fastening portion 28, 44 or to the base 25 by a corresponding annular seal 58, 59. The direct fastening in this case takes place at a standard fastening interface.

In principle however, it is also possible for an adapter plate 60, 61 to be screwed onto the respective fastening portion 28, 44 or the base 25 by means of the connection screws 56, 57, while disposing therebetween the annular seals 58, 59. The adapter plates 60, 61 have corresponding through bores 62, 63 which are then penetrated by the corresponding connection screws 56, 57 which are screwed into the internal-thread bores 29 or 33 or 45, respectively. The adapter plates 60, 61 in the example shown furthermore have four further internal-thread bores 64, 65 which serve for fastening a connector flange plate 66, 67, the latter to this end having corresponding through bores 68, 69 through which the corresponding connection screws 70, 71 are driven and screwed into the internal-thread bores 64, 65 of the adapter plates 60, 61. Instead of the internal-thread bores 64, 65, it would also be conceivable for through bores to be provided and for the connection screws 70, 71 to be screwed into the internal-thread bore 29, 30, or 45, respectively. Here too, one annular seal 72, 73 is disposed therebetween, said annular seal 72, 73 being configured in a corresponding annular receptacle 74, 75 on the adapter plate 60, 61. This connector flange plate 66, 67 furthermore has internal-thread bores 76, 77 into which connection screws (not shown in more detail) are screwed, the corresponding line then being fastened by means of said connection screws. The disposal of these internal-thread bores 76, 77 can differ from one connector flange plate to another connector flange plate, this means that dissimilar connector flange plates having dissimilar bore patterns and thus connection geometries of different standards can be attached.

Furthermore provided is a stand element 78 which here is embodied so as to be L-shaped and has a vertically running fastening leg 79 on which corresponding through bores 80 which are penetrated by two fastening screws 14 which serve for connecting the radial flange 10 to the second housing part 39 are configured such that the stand element 78 herewith can be selectively fastened to the pump. The stand element 78 by way of a second horizontally running leg 81 bears on the floor[possibly →'base'?] such that the screw spindle pump 1 is supported by way of said leg 81.

FIG. 2, as described, shows a sectional view through a screw spindle pump 1 according to the invention, wherein the adapter plate 60, deviating from the illustration in FIG. 1, here is disposed on the suction connector 27, while the suction connector 32 is closed by way of the closure plug 30. As can be seen, the suction connector 27 which in a radially outward manner by way of the corresponding bores in the adapter plate 60 and the connector flange plate 66 is of course extended in length, opens out into the suction chamber 41 which extends up to the first sealing plane, the latter being implemented by way of the first sealing element which in an axial manner follows toward the right and is in the form of the annular seal 22. Inflowing fluid, or suction fluid, respectively, by way of the inlet openings 15 makes its way into the pump housing 2 and therein is guided by the spindles 3, 16 to the outlet openings 20 where said fluid exits into the surrounding annular suction chamber 42 and makes its way to the pressure connector 43, the latter here of course also being extended in length in an outward manner by way of corresponding bores in the adapter plate 61 and the connector flange plate 67.

As already described, there is the possibility for bringing the two housing parts 24 and 39 to a variable relative position in relation to one another, on the one hand, as well is for bringing the two housing parts 24, 39 to a variable relative position in relation to the pump housing 2. This means that there is double rotatability. This is possible since the pump housing 2 has the cylindrical portion 5, while the two housing parts 24, 39 have corresponding internal cylindrical geometries such that a rotation is possible. At the same time, the housing parts are mutually sealed by way of the corresponding annular seals, wherein these annular seals permit rotation and nevertheless correspondingly seal in the desired rotated position. Particular requirements as a result of the rotatability are not to be set for the annular seals since the housing parts are rotated in a mutually relative manner only once in the context of assembling; the housing parts, or the connector housing, respectively, is/are subsequently fixedly screwed to the pump housing.

Figure 3:
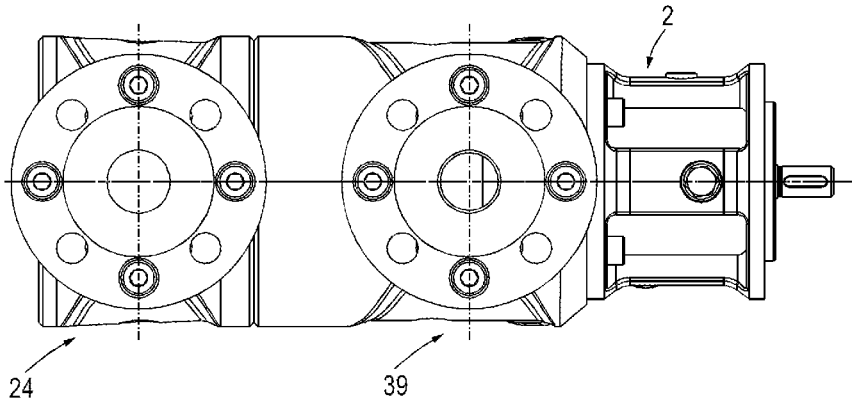
FIG. 3 shows a plan view in the direction of the arrow III from FIG. 2.
Figure 4:
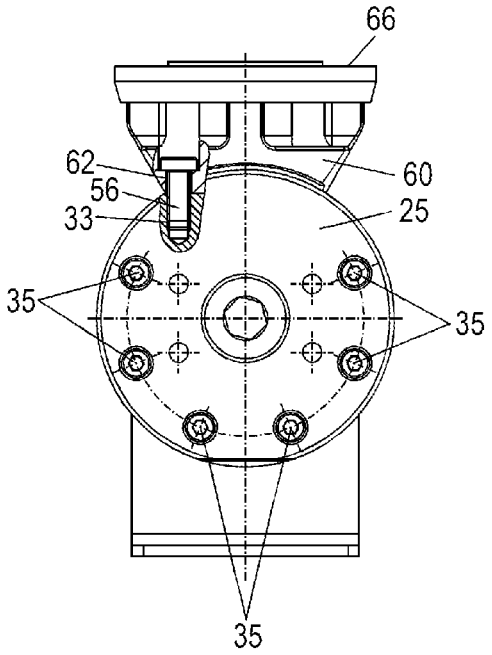
FIG. 4 shows a view of the end side in the direction of the line IV in FIG. 2.

FIG. 2 shows an arrangement in which the two housing parts 24, 39 are disposed so as to be mutually aligned in an axial manner in terms of the pump longitudinal axis, cf. to this end also FIGS. 3 and 4. By virtue of the rotatability of the two housing parts 24, 39 relative to one another as well as relative to the pump housing 2, there is however a multiplicity of further potential arrangements or potential alignments, respectively. The latter are ultimately limited, or limited to defined connecting positions, respectively, only by the pitch of the respective through bores 34 and internal-thread bores 49 on the two connector housings 24, 39, or 54, 55, respectively, on the radial flange 10 and the second connector housing 39. It is assumed that the pitch in both connection planes corresponds in each case to 45°.

FIGS. 5 to 16 show a total of twelve exemplary arrangements of how the suction connectors 27 or 32, respectively, and the pressure connector 43 can be positioned relative to one another. The position of the pump housing 2 is in each case identical in all variants shown in FIGS. 5 to 16, only the housing parts 24 and 39 are brought to dissimilar positions either only relative to the pump housing 2 or else relative to one another.

Figure 5:
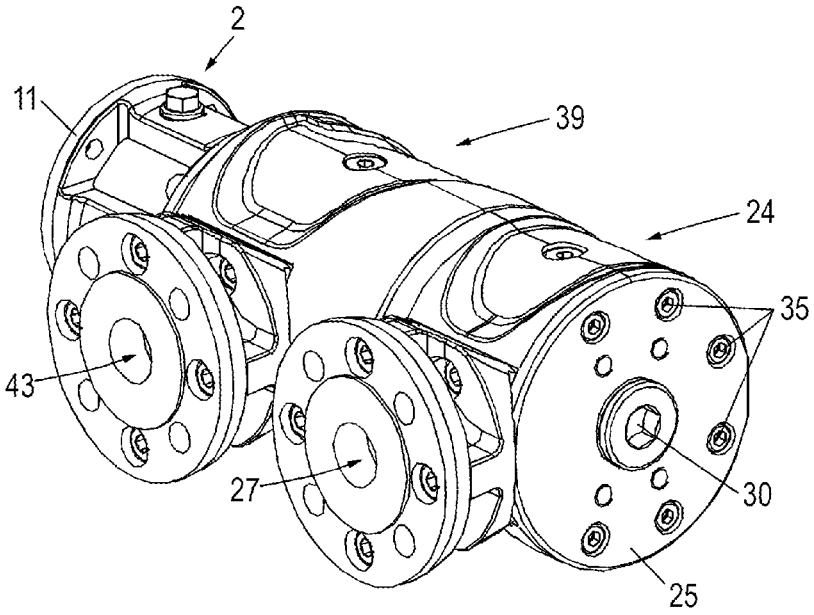
FIGS. 5-16 show various perspective views of dissimilar types of screw spindle pumps which are able to be produced from the elements shown in FIG. 1, having in each case the same positioning of the pump housing but a variable disposal of the first and the second housing part as well as of the suction connector.
Figure 6:
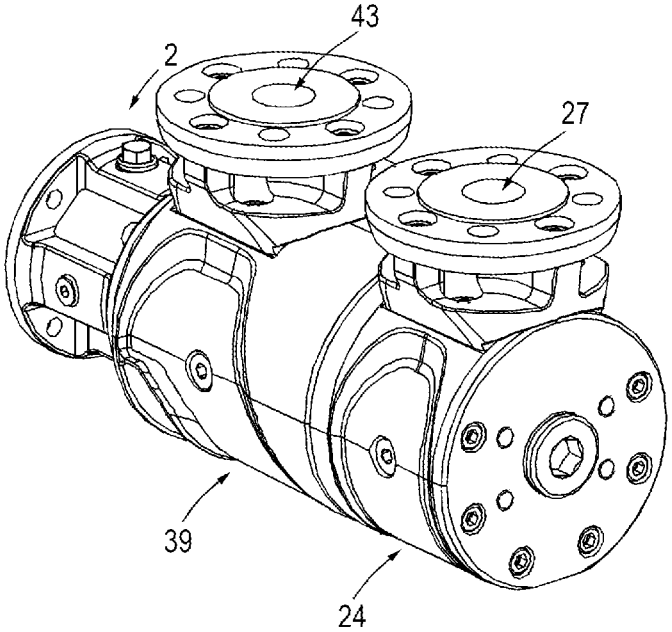
Figure 7:
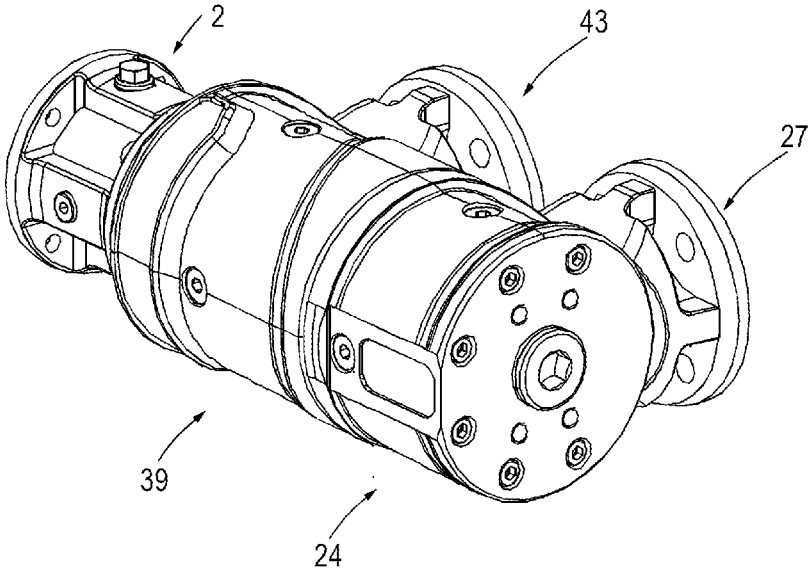

FIGS. 5, 6, and 7 show a linear disposal of the suction and pressure connectors 27, 43, thus along the pump longitudinal axis. While said suction and pressure connectors 27, 43, proceeding from FIG. 5 and when viewed on to the fastening flange 11 of the pump housing 2, are directed toward the right in FIG. 5, said suction and pressure connectors 27, 43 in FIG. 6 stand in a vertically upward manner, so to speak, while said suction and pressure connectors 27, 43 are directed toward the left in FIG. 7. The housing parts 24, 39 here are thus not rotated relative to one another but are in different positions which differ by 90°.

Figure 8:
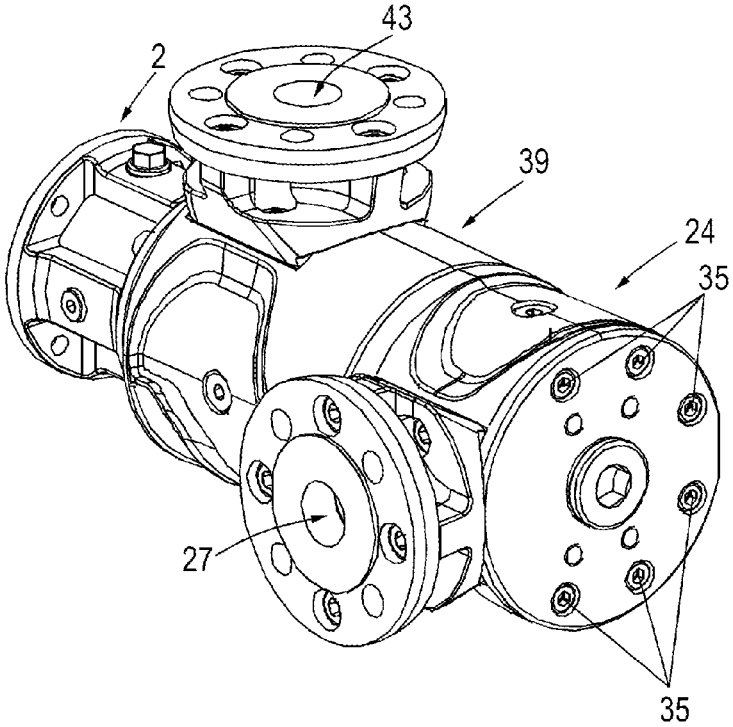

The suction connector 27 in FIG. 8 is directed toward the right, while the pressure connector 43 is directed upward. Both have a mutual angle of 90°, are thus fastened to one another by means of the connection screws 35 so as to be mutually rotated by two pitches of 45°.

Figure 9:
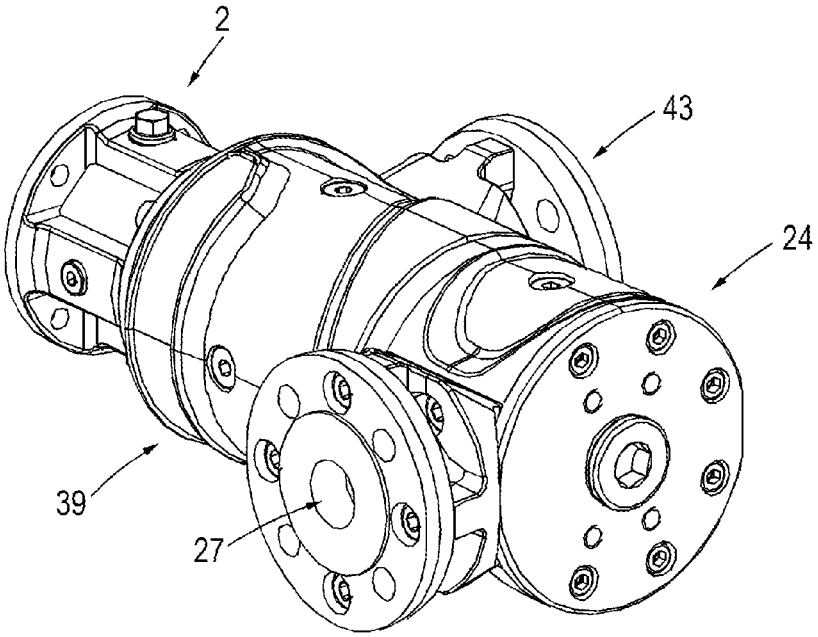

The pressure connector 43 in the design embodiment according to FIG. 9 is disposed so as to be rotated further by yet again 90° such that the suction connector 27 and the pressure connector 43 are directed in opposite directions, the two housing parts 24, 39 thus consequently being mutually rotated by 180°.

Figure 10:
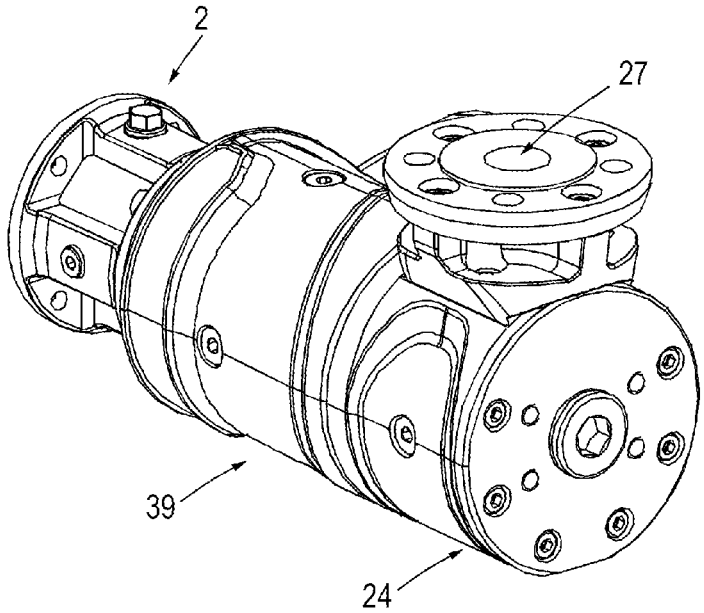
Figure 11:
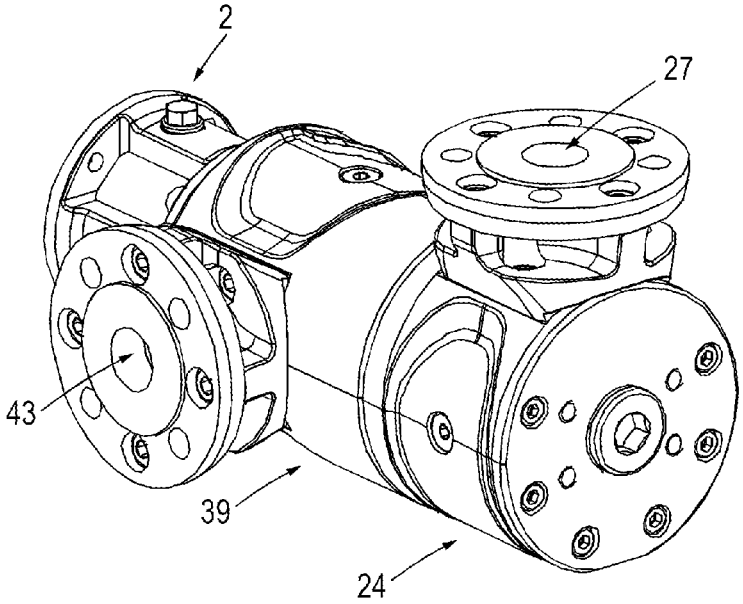

In the design embodiment according to FIG. 10 the suction connector, proceeding from FIG. 9, is rotated by 90° and points vertically upward, while the pressure connector 43 like before is directed toward the left. A 90° configuration is again provided here.

The suction connector 27 in the design embodiment according to FIG. 11 again points upward, while the pressure connector 43 is directed toward the right.

Figure 12:
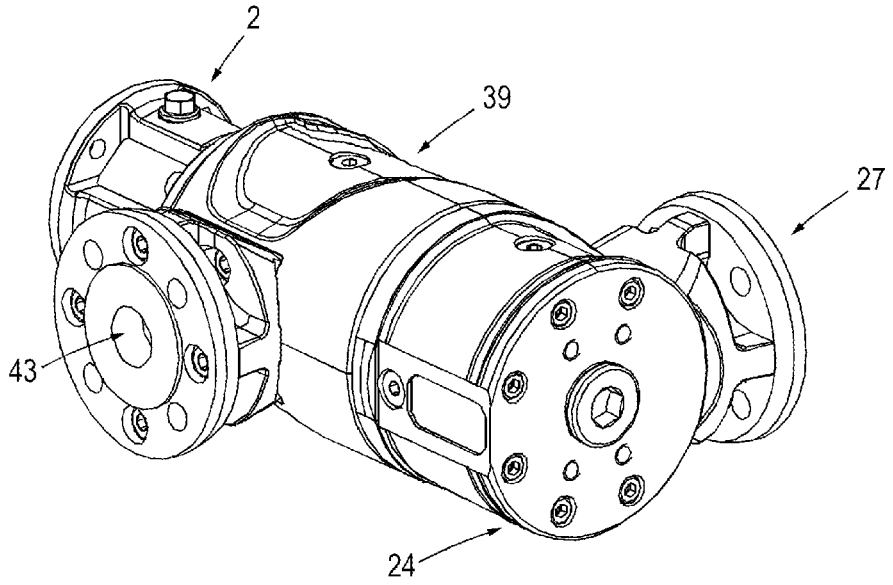

In the design embodiment according to FIG. 12 the suction connector 27 is rotated relative to the pressure connector 43 by a further 90°. Both point in opposite directions, the housing parts 24, 39 thus being mutually rotated by 180°. This variant is the mirror-image design embodiment of the arrangement according to FIG. 9.

Figure 13:
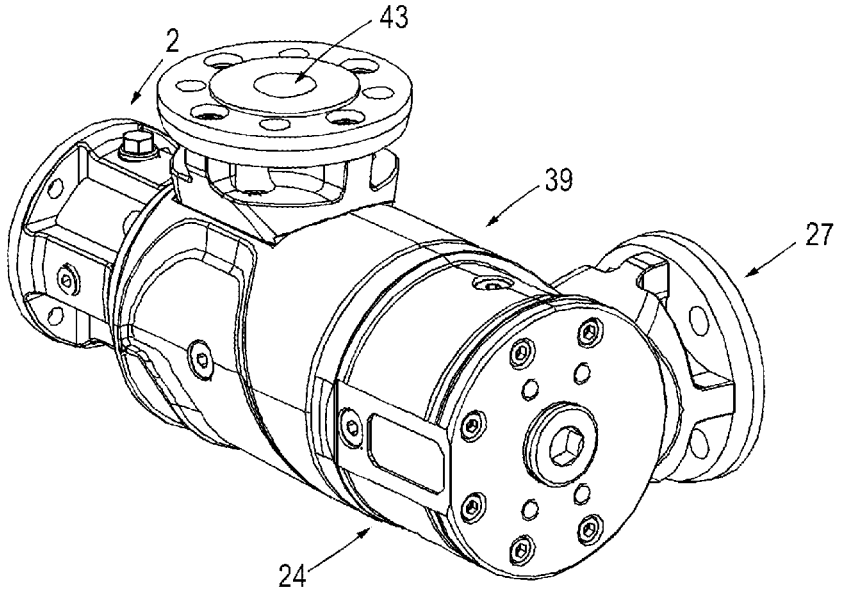

FIG. 13 finally shows an arrangement in which the suction connector 27 is directed toward the left, while the pressure connector 43 is again directed upward; both are at a mutual angle of 90°.

All of the configurations are able to be readily set by virtue of the 45° pitch provided in terms of the through bores and internal-thread bores. In principle, further arrangements can also be implemented as a result of the 45° pitch. That is to say that the suction connectors 27 and the pressure connectors 43 can also be mutually disposed at an angle of 45° or at 35°, if required.

Figure 14:
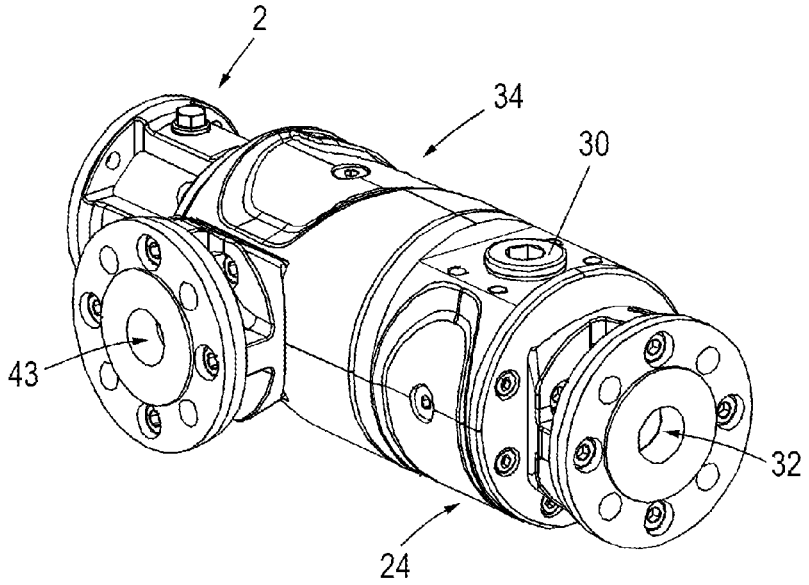
Figure 15:
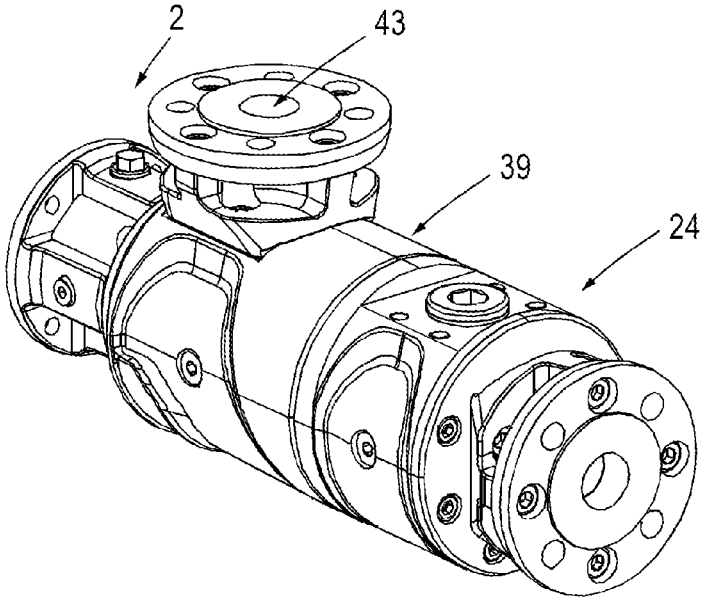
Figure 16:
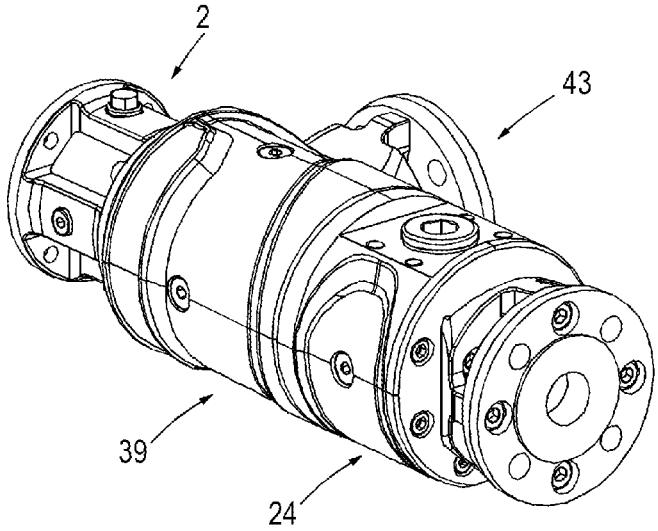

FIGS. 14, 15, and 16 show three variants of arrangement in which the axial suction connector 32 is utilized. While the axial suction connector 32 by way of the closure plug 30 is closed in the design embodiments according to FIGS. 5 to 13, the radial suction connector 27 is closed by way of the closure plug 30 in the design embodiments according to FIGS. 14 to 16. Here, there is the possibility of varying the relative position of the radial pressure connector 43 relative to the axial suction connector 32. While said radial pressure connector 43 in FIG. 14 is directed toward the right, said radial pressure connector 43 according to the design embodiment according to FIG. 15 stands in a vertically upward manner. In the design embodiment according to FIG. 16 the pressure connector 43 is finally directed toward the left.

Here too, by virtue of the 45° pitch, there is the possibility of also bringing the pressure connector 43 to intermediate positions which differ by 45°.

All these different pump configurations can be implemented with one and the same set of pump components. This is because the modular system according to the invention enables these different configurations to be configured by simply rotating the components relative to one another while using a standardized pump housing 2 and using two standardized housing parts 24, 39. This offers an extremely high degree of flexibility in terms of the design embodiment of the pump and at the same time simplicity, since only the standardized pump housings 2 having the likewise standardized internal components thereof (spindles, etc.) as well as standardized first housing parts 24 and second housing parts 39 have to be stocked.

Figure 17:
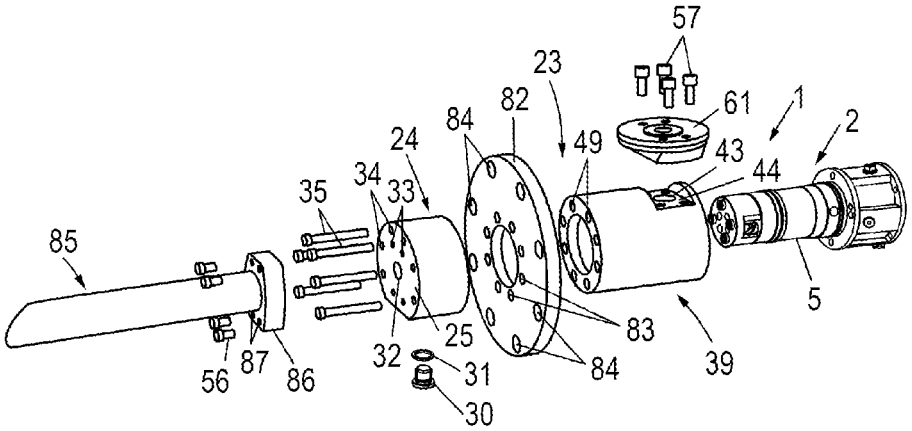
FIG. 17 shows an exploded view of a screw spindle pump according to the invention in a further embodiment.
Figure 18:
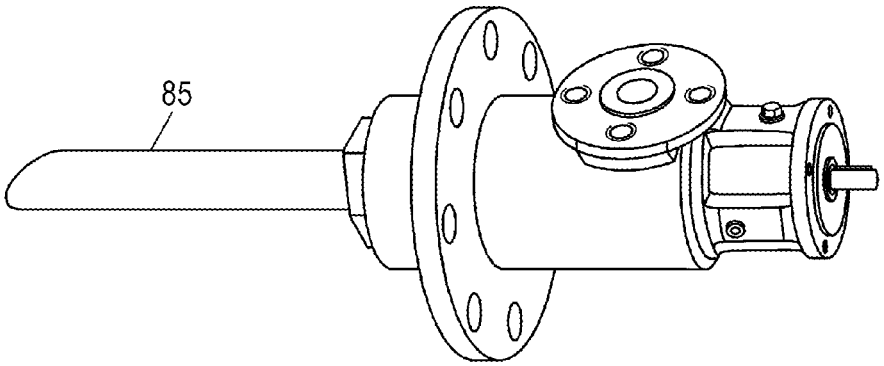
FIG. 18 shows the assembled screw spindle pump from FIG. 17.

FIGS. 17 and 18 show a further embodiment of a screw spindle pump 1 according to the invention in the form of simplified schematic illustrations, wherein the same reference signs are used for the same components. For reasons of simplicity, only a reduced number of components is shown here in the exploded illustration according to FIG. 17. In principle however, the basic construction of this screw spindle pump also corresponds to that described above.

Provided here is also a pump housing 2 as well as a connector housing 23 comprising a first housing part 24 and a second housing part 39. Said housing parts 24 and 39 are in turn pushed onto the cylindrical portion of the pump housing 2 in the manner described above and by way of corresponding sealing elements are sealed relative to one another and in relation to the pump housing 2. In this design embodiment, a radial flange 82 is placed between the two housing parts 24, 39. Said radial flange 82 has through bores 83 which are in alignment with the through bores 34 on the first housing part 24. The connection screws 35 penetrate the through bores 34 and 83, and here too are screwed into the corresponding internal-thread bores 49 on the second housing part 39.

The radial flange 82 furthermore has through bores 84 which in a radial manner lie further outward and serve for receiving connection screws by way of which the screw spindle pump 1 can be screwed to a fastening geometry which is not shown in more detail.

In this design embodiment, a suction tube 85, which has a fastening flange 86 having through bores 87 through which the connection screws 56 which are screw-fitted in the internal-thread bores 33 of the base 25 of the first housing part 24 are guided, is connected to the axial suction inlet 32. This is of course performed while disposing therebetween the annular seal 58, this however not being shown in more detail here.

The second suction connector 27 here is closed by means of the closure plug 30.

An adapter plate 61 by means of the fastening screws 57 is fixed to the fastening portion 44 having the pressure connector 43, as has already been described above.

This design embodiment enables the configuration of an immersion pump which can be assembled in a tank, either in a horizontal or vertical arrangement.

While specific embodiments of the invention have been shown and described in detail to illustrate the inventive principles, it will be understood that the invention may be embodied otherwise without departing from such principles.

We claim:

1. A screw spindle pump, comprising a pump housing having a lead screw received therein and at least one running spindle which meshes with said lead screw, as well as a connector housing surrounding the pump housing and having a suction connector and a pressure connector, the two latter fluidically communicating with a suction inlet and a pressure outlet of the pump housing, wherein the connector housing is composed of a first housing part and a second housing part, one of the two latter having the suction connector and the other having the pressure connector, both said housing parts being rotatable relative to the pump housing and both being rotatable relative to one another, wherein the first housing part and the second housing part are mutually fixable in multiple desired alignments, and wherein the first housing part and the second housing part are connectable to the pump housing in multiple desired alignments.

2. The screw spindle pump according to claim 1, wherein each housing part is rotatable relative to the pump housing by at least 45°.

3. The screw spindle pump according to claim 2, wherein each housing part is rotatable relative to the pump housing by 360°.

4. The screw spindle pump according to claim 1, further comprising sealing elements by way of which the housing parts are mutually sealed and at least one housing part is also sealed in relation to the pump housing.

5. The screw spindle pump according to claim 4, wherein the housing part that has the suction connector is sealed in relation to the housing part that has the pressure connector, and the housing part that has the pressure connector is sealed in relation to the pump housing.

6. The screw spindle pump according to claim 4, wherein one of the housing parts has a cylindrical flange which extends axially and engages in an annular beading on the other housing part, wherein the sealing element that mutually seals the two housing parts seals between the flange and the annular beading.

7. The screw spindle pump according to claim 4, wherein annular seals that are inserted in annular receptacles are provided as sealing elements.

8. The screw spindle pump according to claim 1, wherein the suction inlet is formed by one radial inlet opening, or a plurality of radial inlet openings configured so as to be distributed in the circumferential direction on the pump housing, which opens out into a suction chamber that is configured between the one housing part and the pump housing, and the pressure outlet is formed by one radial outlet opening, or a plurality of radial outlet openings configured so as to be distributed in the circumferential direction on the pump housing, which opens out into a pressure chamber that is configured between the second housing part and the pump housing.

9. The screw spindle pump according to claim 8, wherein at least two inlet openings and at least four outlet openings are provided.

10. The screw spindle pump according to claim 8, wherein further axial inlet openings that form the suction inlet are configured on an end-proximal base of the pump housing.

11. The screw spindle pump according to claim 1, wherein only one radial suction connector, or one radial suction connector and one axial suction connector, is/are provided on the suction-proximal housing part.

12. The screw spindle pump according to claim 11, wherein in the instance of two suction connectors one thereof is closed by means of a releasable closure element.

13. The screw spindle pump according to claim 1, wherein the housing parts in distinguished or arbitrary rotated positions relative to one another are fixable on one another, and one housing part in terms of the rotated position thereof in distinguished or arbitrary positions relative to the pump housing is fixable on the latter.

14. The screw spindle pump according to claim 13, wherein screw connections are provided for fixing.

15. The screw spindle pump according to claim 14, wherein a plurality of axial through bores are provided so as to be distributed in the circumferential direction on the suction-proximal housing part, and a plurality of axial internal-thread bores are provided so as to be distributed with uniform angular separation in the circumferential direction on the neighboring housing part, and/or in that a plurality of axial through bores are provided so as to be distributed in the circumferential direction on a radial flange of the pump housing, and a plurality of axial internal-thread bores are provided so as to be distributed with uniform angular separation in the circumferential direction on the neighboring housing part.

16. The screw spindle pump according to claim 15, wherein the through bores and internal-thread bores have an angular separation between 15° and 90°.

17. The screw spindle pump according to claim 1, wherein at least two axially open slots are provided so as to extend in the circumferential direction on the suction-proximal housing part, and a plurality of axial internal-thread bores are provided so as to be distributed in the circumferential direction on the neighboring housing part, and/or or in that at least two axial slots are provided so as to extend in the circumferential direction on a radial flange of the pump housing, and a plurality of axial internal-thread bores are provided so as to be distributed in the circumferential direction on the neighboring housing part.

18. The screw spindle pump according to claim 1, wherein a plurality of discharge bores which are provided with releasable closure plugs and lead into the interior of the connector housing are provided so as to be distributed in the circumferential direction on each housing part.

19. The screw spindle pump according to claim 18, wherein three discharge bores which are disposed so as to be mutually offset by 90° are provided per housing part.

20. The screw spindle pump according to claim 1, wherein a flat fastening region having a plurality of internal-thread bores for fastening a line to be connected to the suction connector and to the pressure connector is configured in the region of the suction connector and pressure connector on both housing parts.

21. The screw spindle pump according to claim 20, wherein an adapter plate which is able to be releasably fastened to the fastening region and which has fastening installations for fastening at least one connector flange plate is provided.

22. The screw spindle pump according to claim 1, further comprising a stand element that is releasably attachable to the pump housing.

23. The screw spindle pump according to claim 22, wherein the stand element is L-shaped or U-shaped and has a leg having at least two bores provided thereon, screw connections by way of which the pump housing is connected to the neighboring housing part engaging through said bores.

24. The screw spindle pump according to claim 16, wherein the angular separation is between 22.5° and 45°.

* * * * *